US008997317B2

(12) United States Patent
Rinklake

(10) Patent No.: US 8,997,317 B2
(45) Date of Patent: Apr. 7, 2015

(54) CONNECTOR FOR FALL PROTECTION

(75) Inventor: Kai Rinklake, Neuwied (DE)

(73) Assignee: Skylotec GmbH, Neuwied (DE)

( * ) Notice: Subject to any disclaimer, the term of this patent is extended or adjusted under 35 U.S.C. 154(b) by 207 days.

(21) Appl. No.: 12/995,462

(22) PCT Filed: May 13, 2009

(86) PCT No.: PCT/EP2009/003416
§ 371 (c)(1),
(2), (4) Date: Nov. 30, 2010

(87) PCT Pub. No.: WO2009/149801
PCT Pub. Date: Dec. 17, 2009

(65) Prior Publication Data

US 2011/0072621 A1 Mar. 31, 2011

(30) Foreign Application Priority Data

Jun. 12, 2008 (DE) ..... 20 2008 007 870 U

(51) Int. Cl.
*A62B 35/04* (2006.01)

(52) U.S. Cl.
CPC ..... *A62B 35/04* (2013.01)

(58) Field of Classification Search
USPC ..... 24/298, 299, 300, 301, 302
See application file for complete search history.

(56) References Cited

U.S. PATENT DOCUMENTS

| | | | | | |
|---|---|---|---|---|---|
| 4,253,544 | A * | 3/1981 | Dalmaso | 182/3 |
| 4,538,702 | A * | 9/1985 | Wolner | 182/3 |
| 4,710,423 | A * | 12/1987 | Imamura | 442/164 |
| 5,174,410 | A * | 12/1992 | Casebolt | 182/3 |
| 5,220,977 | A * | 6/1993 | Wolner | 182/18 |
| 5,287,943 | A * | 2/1994 | Bell | 182/3 |
| 5,611,119 | A * | 3/1997 | Allen | 24/301 |
| 6,085,802 | A * | 7/2000 | Silberberg | 139/387 R |
| 6,202,263 | B1 * | 3/2001 | Harker | 24/300 |
| 6,533,066 | B1 * | 3/2003 | O'Dell | 182/3 |
| 6,938,306 | B2 * | 9/2005 | Joubert et al. | 24/300 |
| 7,093,329 | B1 * | 8/2006 | Chiu | 24/301 |
| 7,458,135 | B2 * | 12/2008 | Mikesell et al. | 24/300 |
| 7,665,575 | B2 * | 2/2010 | Tanaka et al. | 182/3 |
| 2001/0001340 | A1 * | 5/2001 | Libecco | 24/300 |
| 2001/0047573 | A1 * | 12/2001 | Anderson | 24/300 |
| 2002/0194712 | A1 * | 12/2002 | Jackson et al. | 24/300 |
| 2004/0115390 | A1 * | 6/2004 | Hess et al. | 428/99 |
| 2005/0097710 | A1 * | 5/2005 | Johnson | 24/300 |
| 2005/0189169 | A1 | 9/2005 | Tanaka | |
| 2005/0217748 | A1 | 10/2005 | Ikegami | |

FOREIGN PATENT DOCUMENTS

| | | |
|---|---|---|
| DE | 9401500 | 3/1994 |
| EP | 1360431 | 11/2003 |

* cited by examiner

*Primary Examiner* — Robert J Sandy
*Assistant Examiner* — David Upchurch
(74) *Attorney, Agent, or Firm* — Robert Curcio; DeLio, Peterson & Curcio, LLC

(57) ABSTRACT

In the case of a fall protection connector for connecting a strap to a load-fastening point for a person to be protected against falling, wherein the fall protection connector has a tubular band, at the ends of which respective connecting elements are arranged, wherein a length-variable element is arranged in the tubular band, the arrangement has been brought about in such a manner that the tubular band is formed from an elastic material.

31 Claims, 3 Drawing Sheets

CONNECTOR FOR FALL PROTECTION

This application is a National Stage filing based on PCT/EP2009/003416, filed May 13, 2009, and which claims priority to German Patent Application No. DE20 2008 007 870.9, filed Jun. 12, 2008.

BACKGROUND OF THE INVENTION

Field of the Invention

The present invention relates to a fall protection connector for connecting a strap of a person to be protected against falling to a load-fastening point, wherein the connector comprises a tubular band at the ends of which respective connecting elements are arranged, wherein a length-variable element is arranged in the tubular band.

Fall protection connectors with fall dampers serve to secure persons in areas where there is a risk of falling. They are fastened at one end to the strap of the person to be protected and at the other end to a fixed load-fastening point. Connecting means of this type always comprise a fall damping element which, in the event of a fall, reduces the forces acting on the person when the fall is arrested, as well as an elongating element, such as a rope or a webbing band with which the required effective length is reached. The fall damping element can also be constructed over the entire length. Connecting means are described, for example, in EN 354 in conjunction with EN 355 for use in industry and for safe working as well as in EN 958 for use in the fields of sport and mountain climbing.

A disadvantage of known fall protection connectors is that a particular length is required in order to achieve sufficient freedom of movement. If the fall protection connector is not used and hangs on the strap, then this length is problematic since a person could become caught on components. In order to rectify this disadvantage, connecting means exist which are elastic. These can be configured as follows, (1) as fall dampers with elastic connecting means, e.g., webbing band in a tubular design with an internally arranged rubber element;

(2) as fall dampers with a damping element constructed over the entire length, completely within the tubular band as a supporting element or only a protective sleeve, also with an internally arranged rubber band; or (3) as fall dampers with elastic connecting means made from webbing band or rope, which is made as elastic band or rope.

The first and third variants above suffer from the disadvantage that a fall damper has to be combined with a connector and that their design does not involve damping taking place over the whole length. The disadvantage of the first and second variants is that a separate elastic element has to be included internally in the protective tube. This is an additional part which must be separately produced and processed. Furthermore, the protective tube is thereby pushed together, which produces a bellows effect and is disadvantageous for the force development in the event of a fall over an edge.

EP 1 360 431 B1 discloses a connecting means of the aforementioned type having a fall damper for absorbing the impact forces arising during a fall of a secured person, wherein a protective sleeve which surrounds the fall damper is provided. The protective sleeve is provided with a predetermined tearing site so that the protective sleeve tears when the fall damper extends in the longitudinal direction when arresting a fall, so that the fall damper can freely extend in the longitudinal direction and can therefore absorb the arresting impact with reduced forces. In known manner, energy is dissipated over an extended period of time by means of the extension of the fall damper, so that the resultant acceleration values are low when arresting the fall.

BRIEF SUMMARY OF THE INVENTION

It is an object of the invention to improve a connecting element of the aforementioned type with regard to handling and functional reliability.

This aim is achieved with a fall protection connector having the characterizing features as described herein.

Advantageous embodiments of the invention are disclosed in the claims.

The invention will be explained in more detail herein below with reference to the drawing, in which.

DETAILED DESCRIPTION OF THE INVENTION

In a fall protection connector of the aforementioned type, it is provided according to the invention that the tubular band is made from an elastic material.

This has the advantage that the tubular band contracts so that, with the length-variable element in the rest position, the fall protection connector has a smooth surface. A bellows effect of the tubular band is thereby precluded. Tangling of the tubular band, which could impair the functioning of the length-variable element or of the fall damper is thereby reliably prevented and the functional reliability of the fall protection connector is correspondingly increased. Handling of the connecting element is also simpler since without any bellows effect, the tubular band has a smooth surface and the connector does not tend to twist in on itself.

In a preferred embodiment, the length-variable element comprises a fall damping element and/or an elastically extensible element, in particular a rubber band.

In an exemplary embodiment, the tubular band is configured as a supporting element of the fall protection connector.

In a preferred embodiment, the length-adjustable element connects the connecting elements to one another and forms a supporting element of the fall protection connector.

In an alternative embodiment, the length-adjustable element does not extend over the whole length of the fall protection connector between the connecting elements, but the fall damper is connected to the tubular band at least at one end, in particular at both ends, spaced apart from each connecting element.

Suitably, at least one of the connecting elements and in particular, both connecting elements, are configured as carabiner hooks or loops.

The tubular band is given an additional function of damping the arresting impact in that the tubular band is configured such that, with the fall damper unloaded, the tubular band is contracted and, when the fall damper extends, also extends to follow the fall damper.

In an exemplary embodiment, arranged on at least one of the connecting elements of the fall protection connector is a fall damping element which has at the free end thereof facing away from the fall protection connector, an additional connecting element. This further connecting element on the fall damping element is configured, for example, as a carabiner hook or a loop.

Figure 1:
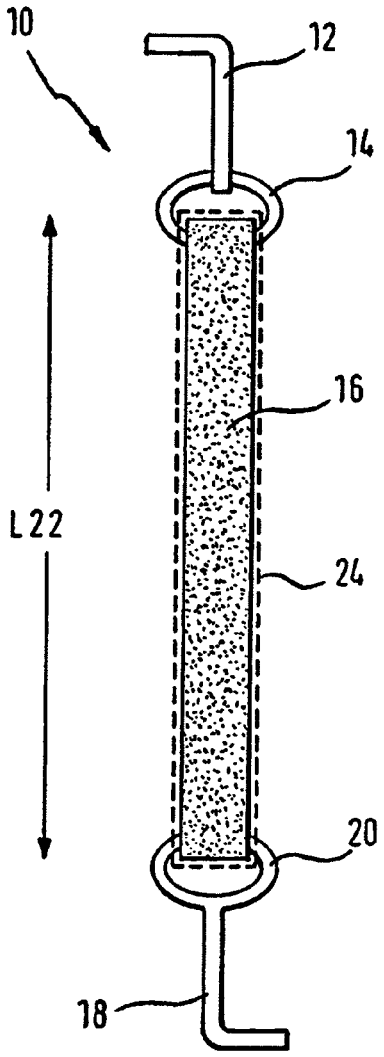
FIG. 1 shows a preferred embodiment of a fall protection connector according to the invention in a schematic sectional view in the rest position thereof.

The preferred embodiment of a fall protection connector 10 shown in FIG. 1 has, at one end, a first connecting element 12, which is configured for the releasable fastening of the fall protection connector 10 to a load-fastening point (not shown). Provided at the connecting element 12 is a first load suspension element 14, which is connected to a length-adjustable element in the form of a fall damping element 16. Provided at an end of the fall damping element 16 opposing the first connecting element 12 is a second connecting element 18 with second load suspension element 20 to which the fall damping element 16 is fastened. The fall damping element 16 with a length L 22 is configured, for example, from a plurality of threads of a special filament yarn. A protective sleeve 24 in the form of a tubular band is provided to protect the fall damping element 16 against, for example, mechanical wear, such as chafing, and against UV radiation.

The fall damping element 16 comprises, for example, thermoplastic polymers. Carabiner-like parts made from plastics, textiles or metal are provided, for example, for the connecting elements 12, 18. The carabiner-like parts are produced from materials such as high-strength plastics and yarns or metal alloys.

The load suspension elements 14 and 20 each serve in the exemplary embodiment shown to fasten the fall damping element 16 to the connecting elements 12 and 18. They can be integrated into the fall protection connector 10 or fastened to the fall protection connector 10 as separate elements, wherein a plurality of connecting elements, for example, two rings can also be provided. The load suspension elements 14, 20 are designed not to have any sharp edges, preferably only rounded edges. The load suspension elements 14, 20 are made from metal, metal alloys, plastics or high-strength fibers. The material of the fall damping element 16, such as the filament yarn has the property of extending during a fall of a person secured with the fall protection connector 10 to a load-fastening point and of continuously reducing the forces arising during arresting of the fall.

The protective sleeve 24 is also connected at the ends thereof to the connecting elements 12 and 18 and, during a fall, absorbs no, or only minimal, force.

However, this is merely one exemplary embodiment. In an alternative embodiment, the protective sleeve 24 is a supporting element of the fall protection connector 10.

All the parts of the fall protection connector 10 are entirely or at least partially surrounded by the protective sleeve 24, so that only parts of the two connecting elements 12, 18 are visible from outside. Advantageously, a plurality of protective sleeves are also used, wherein the allocation thereof is matched to the various functions of the fall protection connector 10.

According to the invention, the protective sleeve 24 is made from an elastic material which, in the starting condition of the unloaded fall damping element 16 as shown in FIG. 1, is in the contracted condition and accordingly surrounds the fall damping element 16 with a smooth surface which is not folded together in bellows-like manner.

Figure 2:
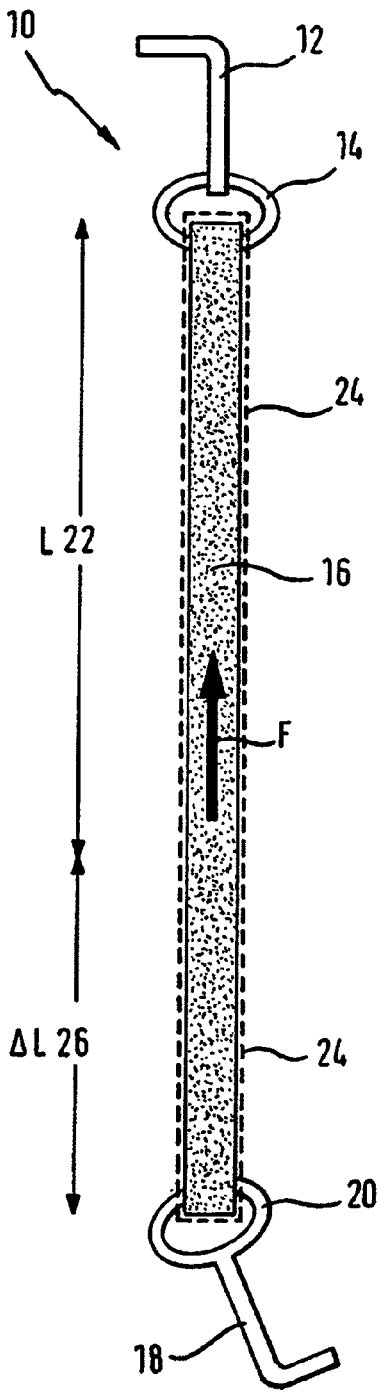
FIG. 2 shows the fall protection connector of FIG. 1 under load or after arresting a fall.

FIG. 2 shows a schematic representation of the connecting element under load. The connecting elements 12, 18 and the load suspension elements 14, 20 correspond to those of FIG. 1. The protective sleeve 24 has extended to follow the fall damping element 16 so that the fall damping element 16 can extend unhindered. The properties of the fall damping element 16, for example, a filament yarn bundle, are configured such that the testing standard according to European Norm EN 355 (1992) is met as closely as possible. Accordingly, under load, the filament yarn bundle absorbs an almost constant force F (<6.0 kN) until the test mass (100 kg) is entirely static. Following braking of the mass, the fall damper has extended by the length ΔL 26 and remains in this condition. The fall damping element 16 must be replaced following such loading.

The fall damping element 16 can be configured in a wide variety of ways. Of decisive importance to the properties thereof are the material, the extension behavior, the number of fibers and the length. If a collection of loops of different lengths is used as the fall damping element 16, then the properties of the fall damper are the result of a superposition.

Plastics in the form of fiber bundles are preferably used as materials for the filament yarns. For example, polypropylenes with different extension properties are particularly suitable for damping the dynamic forces. The fall damping element 16 is configured as a single fiber bundle (loose, parallel-arranged fibers), as one or more loops, as woven, knitted or braided band, or as knitted, braided, plaited or twisted rope.

The material used has different lengths and/or thicknesses. Thus the fall damping element 16 can also exist as a rope core surrounded with weaving or braiding. A non-oriented or only partially oriented filament yarn (LOY, low oriented yarn or POY, partially oriented yarn) is preferably used as the material for the fall damping element (Chemie Faser Lexikon, Hans J. Koslowski, Deutscher Fachverlag, 11th edition, pp. 95 and 137 (1997)).

In a first extension region of a force/extension characteristic curve of the fall protection connector 10 according to the invention, the force absorption increases rapidly. Thereafter, the yarn shows a second extension region adjoining the first, having a constant force absorption up to a value $F_{kFiber}$ over as long an extension region as possible. This region is fully utilized for the even uptake of force by the fall damper. The subsequent rise to a multiple factor of the force on further extension of the yarn in a third extension region adjoining the second prevents tearing of the fall damper under high loading. This ensures a gentle decrease in the fall rate without consequent injury to the falling body and, on overloading, the remaining forces of the arresting impact are absorbed until the falling body is static. As an option, for an additional safety reserve, a material or a loop with more tear-resistant yarn (for example, DYNEEMA®, an Ultra-High Molecular Weight Polyethylene (UHMwPE) fiber (such as that provided by DSM Dyneema B.V., of Mauritslaan 49, 6129 EL Urmond, The Netherlands) having a minimum length L+ΔL (length L 22 of the fall damping element 16 plus the extension length of the fall damper ΔL 26) can be integrated into the fall protection connector 10. This prevents tearing of the fall protection connector 10 even on severe loading.

If a number of similar loosely assembled yarn fibers or yarn threads are provided in the fall damping element 16, a new force/extension curve results, as the consequence of overlaying the individual force/extension curves. The three extension regions described also apply to this force-extension behavior of the fall damping element.

The embodiment shown in FIGS. 1 and 2 is merely exemplary. Alternatively, the protective sleeve 24 is a supporting part of the fall protection connector 10 and the fall damping element 16 is connected to the protective sleeve, spaced apart from the connecting elements 12, 18, so that the fall damping element 16 extends not over the entire length of the fall protection connector 10 between the connecting elements 12, 18 as shown in FIGS. 1 and 2, but only over a predetermined section of the length of the protective sleeve 24.

In an alternative embodiment (not shown), an elastically extensible element is also arranged within the tubular band or the protective sleeve 24.

Figure 3:
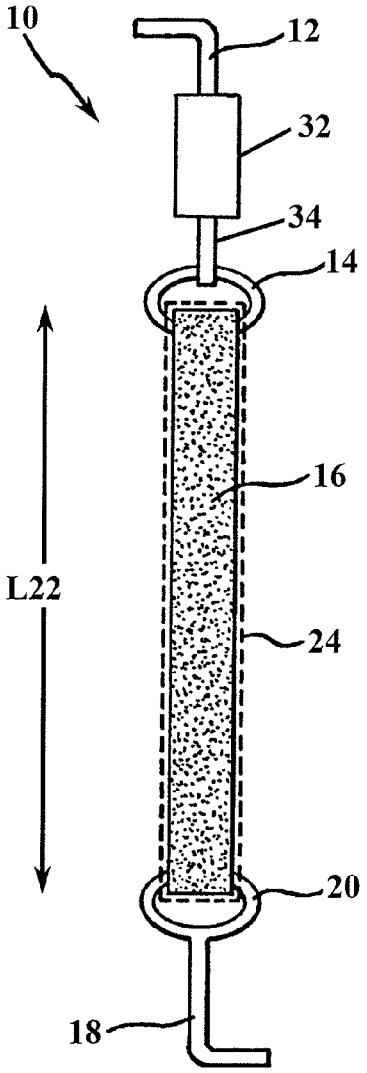
FIG. 3 shows a second embodiment of a fall protector connector in the unloaded or rest position.
Figure 4:
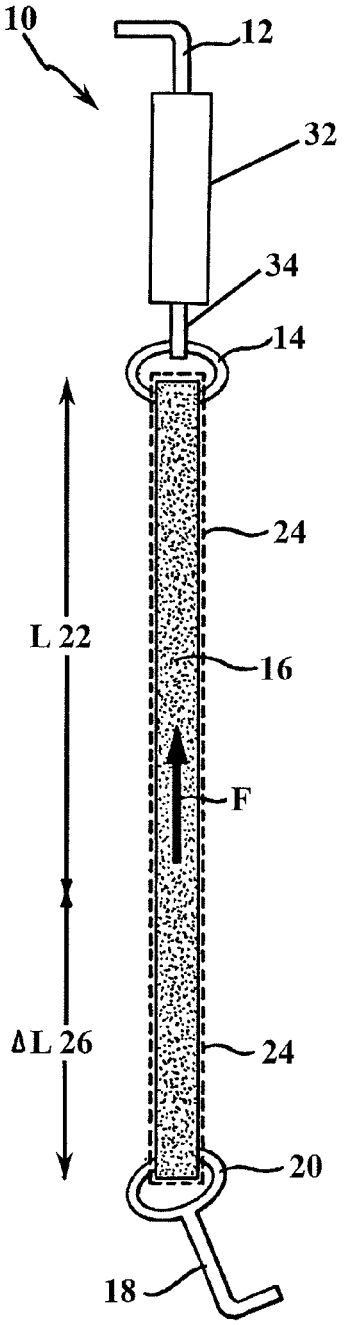
FIG. 4 depicts the fall protector connector of FIG. 3 in the loaded position or after arresting a fall.
Figure 5:
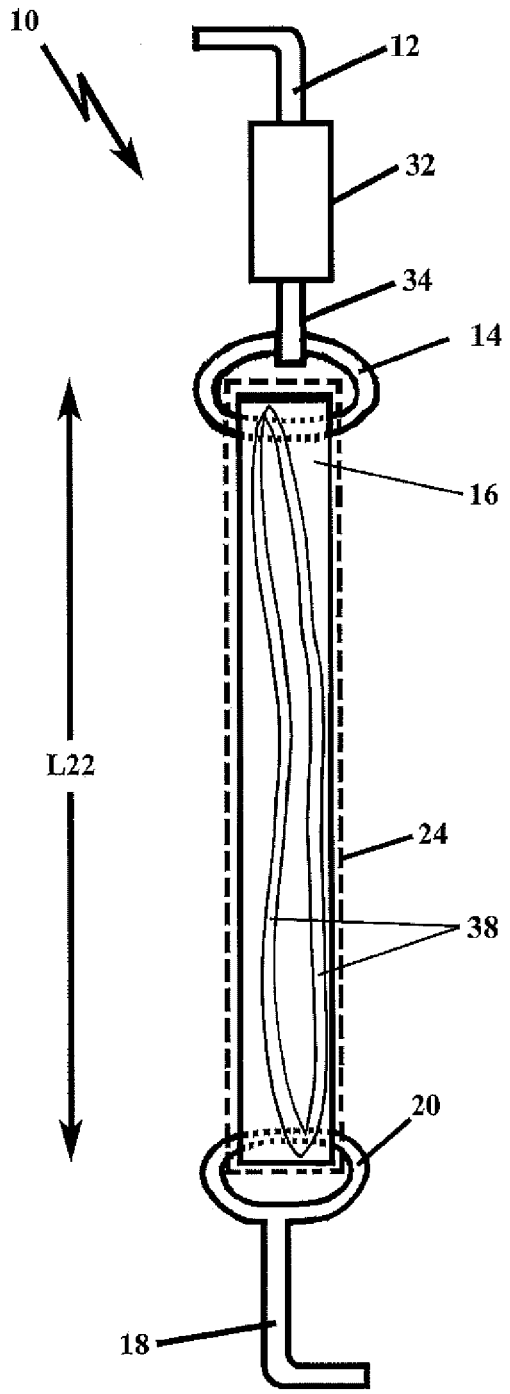
FIG. 5 depicts a fall protector connector with an elastically extensible element.

In a further alternative embodiment an elastically extensible element 38 is arranged as the length-adjustable element within the tubular band or the protective sleeve 24. Optionally, FIGS. 3 and 4 depict a fall damping element 32 in an unextended position (FIG. 3) and in an extended position (FIG. 4) with length adjustable element 36, and additionally connected to one of the connecting elements 12 or 18 or to one of the load suspension elements 14 or 20, respectively, wherein a further connecting element 34 is arranged or configured at a correspondingly free end of the fall damping element 32 facing away from the fall protection connector 10. FIG. 5 depicts the fall protection connector with elastically extensible element 38 shown in a preferred embodiment.

The elastically extensible element essentially serves to increase a radius of action of a person secured with the fall protection connector to a load-fastening point. Herein, both the elastically extensible element and the tubular band 24 made from an elastic material follow the movement of the secured person.

The tubular band or the protective sleeve 24 is itself optionally a supporting element of the fall protection connector 10 or merely fulfils the mechanical protective function. In the latter case, a supporting element is additionally provided within the protective sleeve 24. For example, the fall damping element 16 and/or the elastically extensible element is this supporting element. However, an additional support band can also be provided.

While the present invention has been particularly described, in conjunction with the specific preferred embodiments(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention.

Thus, having described the invention, what is claimed is:

1. A fall protection connector for connecting a strap to a load-fastening point for a person to be protected against falling, wherein the fall protection connector comprises:

a tubular band having ends in which respective connecting load suspension elements are attached, wherein a first fall damping element, in the form of a length-variable element, is arranged in the tubular band, wherein the tubular band includes an elastic material, said first fall damping element connected at each end to said load suspension element; and a second fall damping element not within, nor in direct contact with, said tubular band, and in an initial unextended position which, in the event of a fall becomes extendable, reducing the forces acting on a person when the fall is arrested, said second fall damping element attached on one end to at least one of the connecting load suspension elements of the fall protection connector, said second fall damping element having at an opposite end thereof, a connecting element.

2. The fall protection connector of claim 1, wherein the first fall damping element in the form of a length-variable element comprises an elastically extensible element.

3. The fall protection connector of claim 1, wherein the tubular band is configured as a supporting element of the fall protection connector.

4. The fall protection connector of claim 1, including having the first fall damping element connect the connecting load suspension elements and form a supporting element of the fall protection connector.

5. The fall protection connector of claim 1, including having the first fall damping element connected to the tubular band at least at one end and spaced apart from a respective connecting element.

6. The fall protection connector of claim 1, including having at least one of the connecting elements configured as a carabiner hook or loop.

7. The fall protection connector of claim 1, including the tubular band configured such that, with the first fall damping element unloaded, said tubular band is contracted, and with the first fall damping element extended, said tubular band is also extended following said first fall damping element.

8. The fall protection connector of claim 1, including having the connecting element configured on the first fall damping element as a carabiner hook or a loop.

9. The fall protection connector of claim 1, wherein the first fall damping element in the form of a length-variable element comprises a rubber band.

10. The fall protection connector of claim 2, wherein the tubular band is configured as a supporting element of the fall protection connector.

11. The fall protection connector of claim 3, including having the first fall damping element in mechanical communication with the connecting elements to form a supporting element of the fall protection connector.

12. The fall protection connector of claim 10, including having the first fall damping element in mechanical communication with the connecting elements to form a supporting element of the fall protection connector.

13. The fall protection connector of claim 4, including having first fall damping element connected to the tubular band at least at one end and spaced apart from the respective connecting element.

14. The fall protection connector of claim 3, including having the first fall damping element connected to the tubular band at least at one end and spaced apart from the respective connecting element.

15. The fall protection connector of claim 5, including having at least one of the connecting elements configured as a carabiner hook or loop.

16. The fall protection connector of claim 4, including having at least one of the connecting elements configured as a carabiner hook or loop.

17. The fall protection connector of claim 3, including having at least one of the connecting elements configured as a carabiner hook or loop.

18. The fall protection connector of claim 6, including the tubular band configured such that, with the first fall damping element unloaded, said tubular band is contracted, and with the first fall damping element extended, said tubular band is also extended following said first fall damping element.

19. The fall protection connector of claim 5, including the tubular band configured such that, with the first fall damping element unloaded, said tubular band is contracted, and with the first fall damping element extended, said tubular band is also extended following said first fall damping element.

20. The fall protection connector of claim 4, including the tubular band configured such that, with the first fall damping element unloaded, said tubular band is contracted, and with the first fall damping element extended, said tubular band is also extended following said first fall damping element.

21. The fall protection connector of claim 7, including having the connecting element configured on the fall damping element as a carabiner hook or a loop.

22. The fall protection connector of claim 6, including having the connecting element configured on the fall damping element as a carabiner hook or a loop.

23. The fall protection connector of claim 5, including having the connecting element configured on the fall damping element as a carabiner hook or a loop.

24. The fall protection connector of claim 1, including having the first fall damping element connected to the tubular band at both ends, and spaced apart from the respective connecting element.

25. The fall protection connector of claim 1, including having both connecting elements configured as carabiner hooks or loops.

26. The fall protection connector of claim 1, wherein said second fall damping element is attached on one end to at least one of the connecting load suspension elements by said connecting element.

27. A fall protection connector for connecting a strap to a load-fastening point for a person to be protected against falling, wherein the fall protection connector comprises:

a tubular band having ends in which respective connecting load suspension elements are attached, wherein a first fall damping element, in the form of a length-variable element, is arranged in the tubular band, wherein the tubular band includes an elastic material and is configured such that, with the length-adjustable element unloaded, said tubular band is contracted, and with the length-adjustable element extended, said tubular band is also extended following said length-adjusting element, said first fall damping element connected at each end to said load suspension element; and a second fall damping element not within said tubular band, and in an initial unextended position which, in the event of a fall becomes extendable, reducing the forces acting on a person when the fall is arrested, said second fall damping element attached on one end to at least one of the connecting load suspension elements of the fall protection connector, said second fall damping element having at an opposite end thereof, a connecting element.

28. The fall protection connector of claim 27, wherein the first fall damping element in the form of a length-variable element comprises an elastically extensible element.

29. The fall protection connector of claim 27, wherein the tubular band is configured as a supporting element of the fall protection connector.

30. The fall protection connector of claim 27, including having the first fall damping element connect the connecting load suspension elements and form a supporting element of the fall protection connector.

31. The fall protection connector of claim 27, including having the first fall damping element connected to the tubular band at least at one end and spaced apart from a respective connecting element.

* * * * *